US006371807B1

(12) United States Patent
Takagishi et al.

(10) Patent No.: US 6,371,807 B1
(45) Date of Patent: Apr. 16, 2002

(54) REAR COVER AND PROCESS FOR FORMING RESILIENT SEAL MEMBER THEREIN

(75) Inventors: Takashi Takagishi; Hisashi Tsukamoto, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/551,538

(22) Filed: Apr. 18, 2000

(51) Int. Cl.[7] ..... H01R 13/40
(52) U.S. Cl. ..... 439/587
(58) Field of Search ..... 439/587, 589, 439/364; 604/247

(56) References Cited

U.S. PATENT DOCUMENTS 5,618,198 A * 4/1997 Sato et al. ..... 439/274
5,993,233 A * 11/1999 Fukuda ..... 439/271
6,116,952 A * 9/2000 Nakata ..... 439/587

* cited by examiner

*Primary Examiner*—Brian Sircus
*Assistant Examiner*—Brian S. Webb
(74) *Attorney, Agent, or Firm*—Armstrong, Westerman, Hattori, McLeland & Naughton, LLP

(57) ABSTRACT

A rear cover for use in waterproof connectors and a process for forming a resilient sealing member molded in one piece in the rear cover are provided. The rear cover, in which an electric wire is inserted through a base wall, has a hollow holder pattern on an outer surface of the base wall and a molded-in resilient sealing member containing: a holder formed in the holder pattern; a sealing body extended from the holder, which protrudes toward an inner side of the base wall and has a through hole for the electric wire to pass therethrough; and a plurality of sealing lips formed around the through hole, wherein a portion of periphery of the holder pattern is notched to form a hollow of injection inlet for molding the resilient sealing member in one piece in the rear cover. Thus, the rear cover according to the present invention improves a property of mold releasing and maintenance of a mold. That is, a deformation and damage of the rear cover can be prevented, in addition, an action responding to wear of the mold is easily executed and a fin formation can be prevented.

2 Claims, 9 Drawing Sheets

REAR COVER AND PROCESS FOR FORMING RESILIENT SEAL MEMBER THEREIN

BACKGROUND OF THE INVENTION (1) Field of the Invention

This invention relates to a rear cover for use in waterproof connectors and a process for forming a resilient sealing member molded in one piece in the rear cover.

(2) Description of the Related Art

Waterproof connectors are used for an electrical connection in various fields including motorcars and motorcycles. A waterproof connector is usually consisted of a connector body for making connection to a counter waterproof connector and a rear cover placed on the terminal insertion side of the connector body, which holds an electric wire connected to the terminal that is inserted in the connector body and prevents moisture from entering from the terminal insertion side of the connector body.

A waterproof connector shown in FIG. 8 is generally known and is disclosed in Japanese Patent Application Laid-Open No. H8-96883.

The waterproof connector 1 contains a male connector body 2, a female connector body 3 and a pair of rear covers 4 fitted to each terminal insertion side of the male connector body 2 and female connector body 3, in which a terminal (not shown in FIG. 8) connected to an electric wire 5 is mounted in the male connector body 2 and female connector body 3.

As shown in FIGS. 9 and 11, the rear cover 4 contains a rear cover body 8 made of synthetic resin and a resilient sealing member 9 made of waterproof rubber (for example, silicone rubber) molded in one piece in the rear cover body 8, in which each rear cover 4 is fitted to the corresponding rear of the male connector body 2 or female connector body 3 through a corresponding plate 7 having a hole 6 for the electric wire 5 to pass therethrough.

In the rear cover body 8, there are formed a base wall 10 (see FIG. 10) and a hood 11 (see FIG. 9) formed around the base wall 10. In the base wall 10, there are formed a pair of holes 12 (see FIG. 10) for an electric wire to pass through between inner and outer faces of the base wall 10 and a hollow holder pattern 14 (see FIG. 14) having a plurality of holes 13 (see FIG. 14). In the hood 11, there are formed a piece 15 and a hole 16 for the rear cover 4 to be fitted to the male connector body 2 or female connector body 3.

As shown in FIGS. 12 and 13, the resilient sealing member 9 contains a board-shape holder 17 formed by filling the holder pattern 14 with a waterproof rubber, a sealing body 19 extended from the holder 17, which has a pair of through holes 18 for the electric wire 5 to pass therethrough and protrudes toward an inner face side of the base wall 10, and a plurality of sealing lips 20 (three in FIGS. 12 and 13) formed around each through hole 18, in which a plurality of sealing lips 21 (two in FIGS. 12 and 13) are also formed around the sealing body 19.

The sealing lips 20 assure a seal between the electric wire 5 and the through hole 18. The terminal insertion side of the male connector body 2 or female connector body 3 is inserted between the sealing lip 21 and the hood 11 so that a waterproofing therebetween is assured.

The above plurality of holes 13 shown in FIG. 14 conducts a waterproof rubber into the inner face side of the base wall 10 when the holder pattern 14 is filled with the waterproof rubber.

In the above conventional waterproof connector, as shown in FIG. 8, the pair of rear covers 4 is fitted into each terminal insertion side of the male connector body 2 and female connector body 3 so that a waterproofing at each terminal insertion side portion is assured.

As shown in FIG. 17, a measure to solve the above problem is a split-type mold having such a structure that a pair of insertion parts 24 is inserted into a fixed mold 22' so as to separate a mold for forming the hole 6 from a fixed mold for forming the remaining portion of the resilient sealing member 9 including the sealing portion of the sealing lips 20.

As shown in FIG. 15, the rear cover 4 is produced according to the following steps of: setting the rear cover body 8 in a fixed mold 22; tightening a movable mold 23 with the fixed mold 22; filling the holder pattern 14 with the waterproof rubber in order to mold the resilient sealing member 9 in one piece in the rear cover body 8; and loosening (shown in FIG. 16) the tightening force applied by the movable mold 23 (by moving the mold 23 toward a direction indicated by an arrow shown in FIG. 15) in order to release the molded rear cover 4 from the movable mold 23 (by moving the rear cover 4 toward a direction indicated by an arrow shown in FIG. 16). When the rear cover 4 is released from the mold, a large mold-release force is applied to the hood 11 through a press pin (not shown in the figures), causing a deformation and damage to the hood 11.

As shown in FIG. 15, since a difference between an outer diameter $D_1$ of the movable mold 23 corresponding to the hole 6 (for the electric wire 5 to pass therethrough) and an outer diameter $D_2$ of a sealing portion corresponding to the sealing lips 20 is large, the large mold-release force that may exceed an allowable stress of the hood 11 is needed in order to allow the portion having the outer diameter $D_1$ to pass through the sealing portion having the outer diameter $D_2$ when the rear cover 4 is mold-released. If a mold temperature is set to be high, the hood 11 made of synthetic resin is further easily deformed and damaged.

However, the following process for producing the rear cover 4 causes a deformation and damage to the hood 11 (see FIG. 9), by which are caused an imperfect fitting between the rear cover 4 and the connector bodies 2 and 3, and deterioration in the waterproofing quality.

As for the insertion parts 24 of the split-type mold, there are formed a base 24a that is fixed in the fixed mold 22' and its contiguous portion 24b corresponding to the insertion hole 6, in which a taper 24*c* (outer diameter $D_3$) corresponding to an inclination at the very end of the sealing lips 20 is formed at the end of the portion 24*b*. A movable mold 23' has a portion 23'*a* (outer diameter $D_4$) corresponding to the sealing lips 20, from which a portion corresponding to the insertion hole 6 is removed, resulting in that a difference between the two diameters of the mold becomes small ($D_3$ being nearly equal to $D_4$). Consequently, it is seemed that the mold-release force can be reduced and the deformation and damage of the hood 11 can be prevented from occurring.

However, according to the above split-type mold, in which the insertion parts 24 are inserted in the fixed mold 22', disposing positions of the insertion parts 24 indicated by an arrow P in FIG. 18 interferes with a position of an injection inlet (for injecting the waterproof rubber therethrough) indicated by an arrow Q, resulting in that the above split-type mold is not practically useful as it is.

Nevertheless, an improvement in the above split-type mold is needed since it further has such an advantage that an action responding to wear of the mold (for example, prevention of a fin formation) is easily executed by replacing the insertion parts 24 in addtion to the aforementioned advantage of prevention of the deformation and damage of the hood 11.

SUMMARY OF THE INVENTION

It is therefore an object of the present invention to solve the above problem and to provide a rear cover that gives improvement in a property of mold-releasing and maintenance of a mold, and a process for forming a resilient sealing member molded in one piece in the rear cover.

In order to accomplish the above object, a first aspect of the present invention is to provide a rear cover, in which an electric wire is inserted through a base wall, having a hollow holder pattern on an outer surface of the base wall and a molded-in resilient sealing member containing: a holder formed in the holder pattern; a sealing body extended from the holder, which protrudes toward an inner side of the base wall and has a through hole for the electric wire to pass therethrough; and a plurality of sealing lips formed around the through hole, wherein a portion of periphery of the holder pattern is notched to form a hollow for injection inlet for molding the resilient sealing member in one piece in the rear cover.

In the rear cover according to the first aspect of the present invention, the hollow of injection inlet is formed at a portion of periphery of the holder pattern, thus improving a property of mold releasing and maintenance of a mold.

That is, even if a mold is provided with an insertion part to improve a mold-releasing property, the hollow of the injection inlet, thus formed, allows a separation between the insertion part and the injection inlet, thereby enabling an injection molding to be employed.

Consequently, according to the first aspect of the present invention, a deformation and damage of the rear cover can be prevented. In addition, an action responding to wear of the mold is easily executed and a fin formation can be prevented.

A second aspect of the present invention is to provide a process for forming a resilient sealing member in a rear cover comprising the steps of: forming the rear cover having a hollow holder pattern and a hollow of injection inlet contiguously formed by notching a portion of the periphery of the hollow holder pattern on an outer surface of a base wall; mounting the rear cover in a mold; and filling the hollow holder pattern with a rubber through the hollow of injection inlet, thereby a resilient sealing member containing: a holder formed in the holder pattern; a sealing body extended from the holder, which protrudes toward an inner side of the base wall and has a through hole for an electric wire to be inserted through the rear cover; and a plurality of sealing lips formed around the through hole, is molded in one piece in the ear cover.

According to the second aspect of the present invention, a deformation and damage of the rear cover can be prevented. In addition, an action responding to wear of the mold is easily executed and a fin formation can be prevented.

DESCRIPTION OF THE PREFERRED EMBODIMENTS

In the following, the preferred embodiments of the present invention are explained with reference to the attached drawings.

Figure 1:
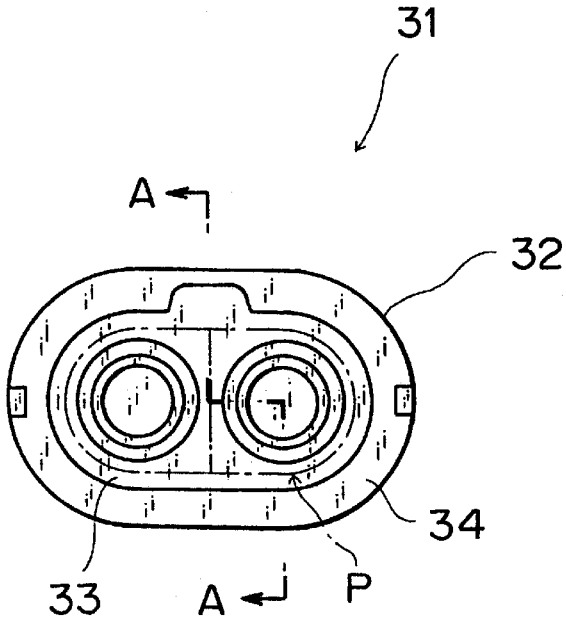
FIG. 1 is a front view of a rear cover according to the present invention.

As shown in FIG. 1, a rear cover 31, which fits to a terminal insertion side of a connector body comprising, for example, a waterproof connector, includes a rear cover body 32 made of synthetic resin and a resilient seal member 33 made of a waterproof rubber (for example, silicone rubber) that is molded in one piece in the rear cover body 32.

Figure 2:
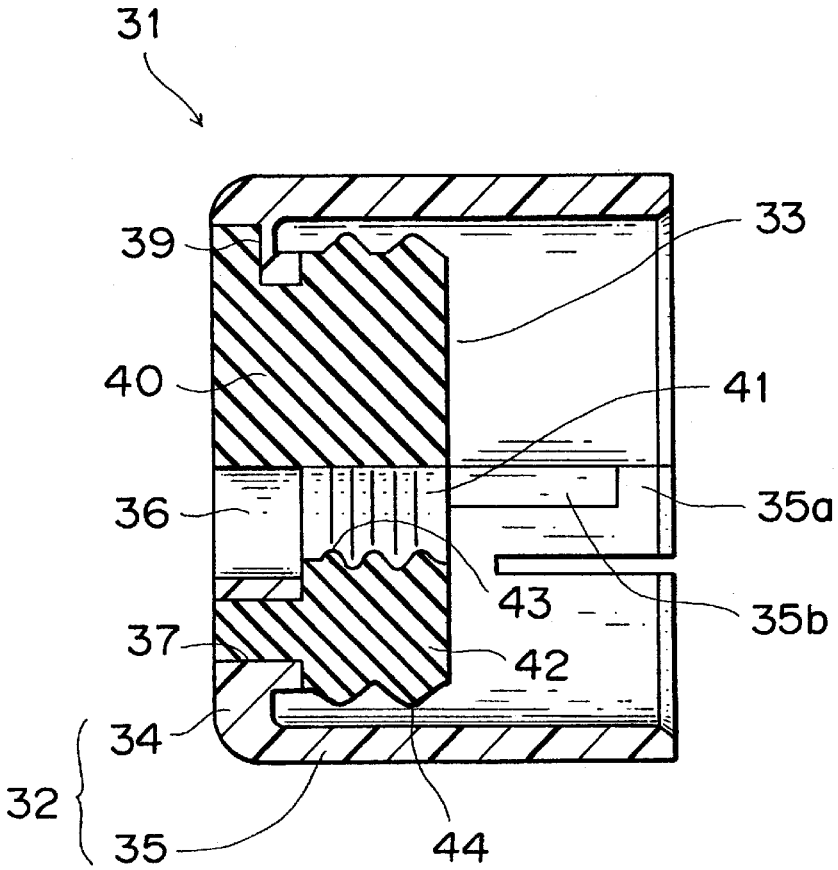
FIG. 2 is a cross-sectional view taken along A—A line in FIG. 1.

As shown in FIG. 2, the rear cover body 32 has a base wall 34 and a hood 35 provided around the base wall 34, in which a pair of round through holes 36 (see FIG. 3) for an electric wire (not shown) to pass through between an inner and outer faces of the base wall is formed.

Figure 3:
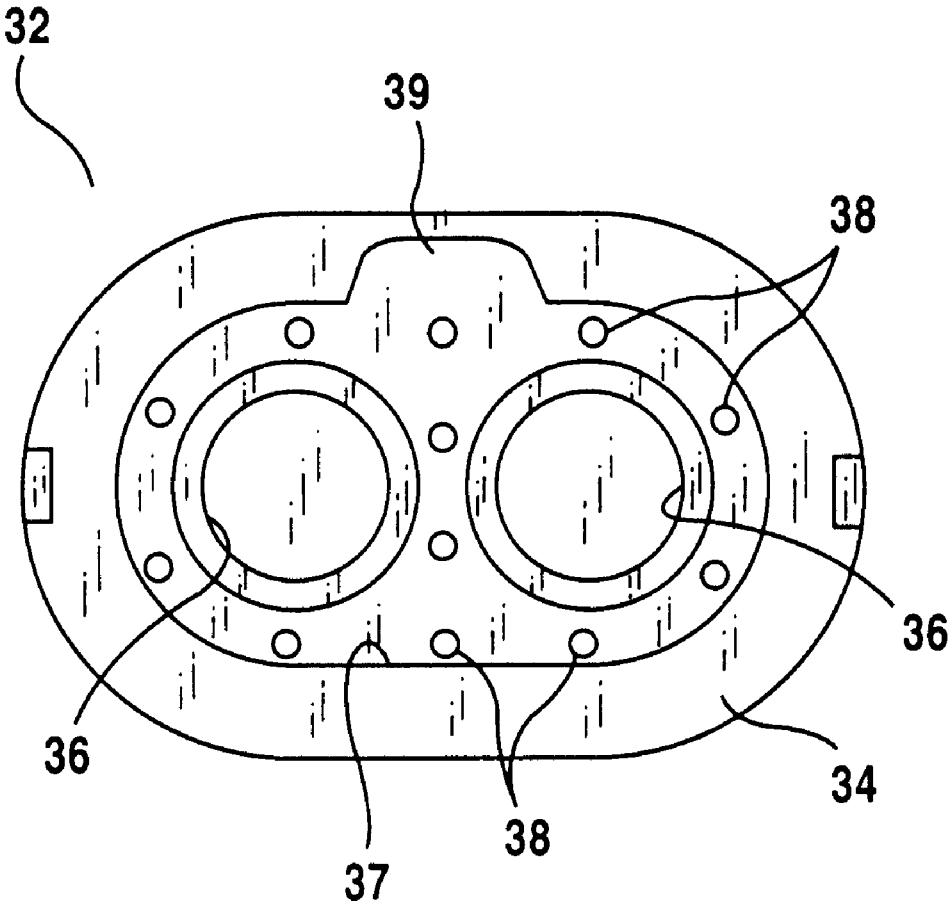
FIG. 3 is a front view of the rear cover body shown in FIG. 1.

As shown in FIG. 3, a hollow holder pattern 37 shaped similarly to the base wall 34 is formed on an outer face (here, a face shown in FIG. 3 being defined as the outer face and a face of the hood 35 side being defined as the inner face) of the base wall 34, and the hollow holder pattern 37 has a plurality of holes 38 that extend to the inner face of the base wall 34.

On the outer face of the base wall 34, there is formed a hollow 39 by notching a portion of the periphery of the hollow holder pattern 37 and an injection inlet for molding is placed at the hollow 39 so as to mold the resilient seal member 33 in one piece in the rear cover 31.

As shown in FIG. 2, the hood 35 has a piece 35*a* and a hole 35*b* to be fitted to the connector body.

On the other hand, as shown in FIG. 2, the resilient sealing member 33 contains: a board-shape holder 40 formed by filling the hollow holder pattern 37 with a waterproof rubber; a sealing body 42 extended from the holder 40, which has a pair of through holes 41 for the electric wire (not shown) to pass therethrough and protrudes toward the inner face side of the base wall 34; and a plurality of sealing lips 43 (three in this portion) formed around through hole 41, in which a plurality of sealing lips 44 (two in this portion) are also formed around the sealing body 42.

The sealing lips 43 assure a seal between the electric wire (not shown) and the through-hole 41. The terminal insertion side of the connector body is inserted between the sealing lips 44 and the hood 35 so that a waterproofing therebetween is assured.

In the following, a formation of the rear cover 31 is explained with reference to FIG. 2. Here, a mold shown in FIG. 17 is used.

The rear cover body 32 is molded by using a known injection molding machine, then the rear cover body 32 is set in the fixed mold 22' (see FIG. 17) and the movable mold 23' is coupled therewith to tighten the molds and then, the hollow holder pattern 37 is filled with a waterproof rubber through the hollow 39. At this time, an end of an injection inlet (not shown) is placed at the hollow 39 so that the end of the injection inlet does not interfere with the insertion parts 24 of the mold. In FIG. 1, an arrow P shows a position of the insertion parts 24.

In the following, how the waterproof rubber filled in the hollow holder pattern 37 flows is explained. The rubber forms the holder 40 in the holder pattern 37 and also flows into the inside of the base wall from the holder pattern 37 through the plurality of holes 38 (see FIG. 3), gradually forming the sealing body 42 and the sealing lips 43 and 44. When the formation of the resilient seal member 33 is completed, the tightening of the mold is loosened and then, the rear cover 31 is released from the movable mold 23' (see FIG. 17) by a press pin (not shown).

Figure 17:
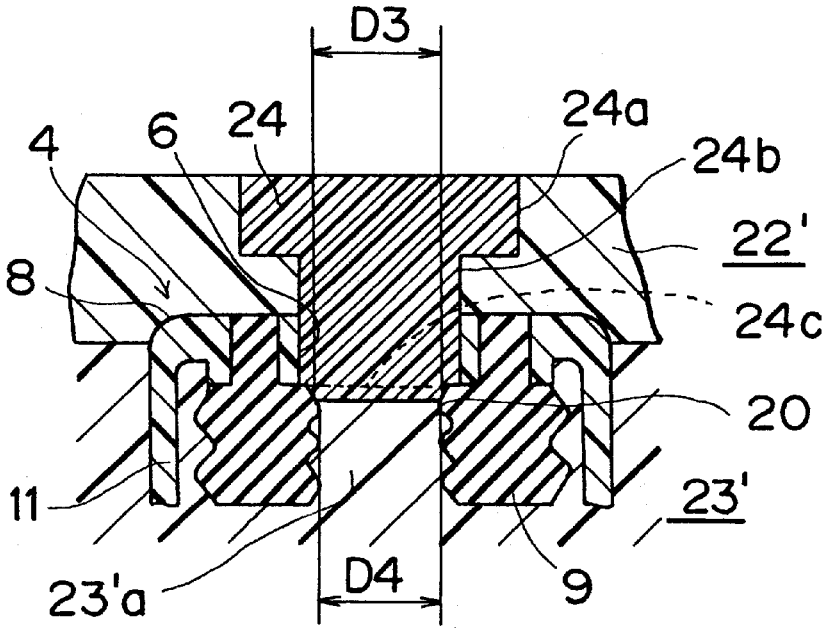
FIG. 17 PRIOR ART
FIG. 17 is a cross-sectional view illustrating a separative mold.
Figure 18:
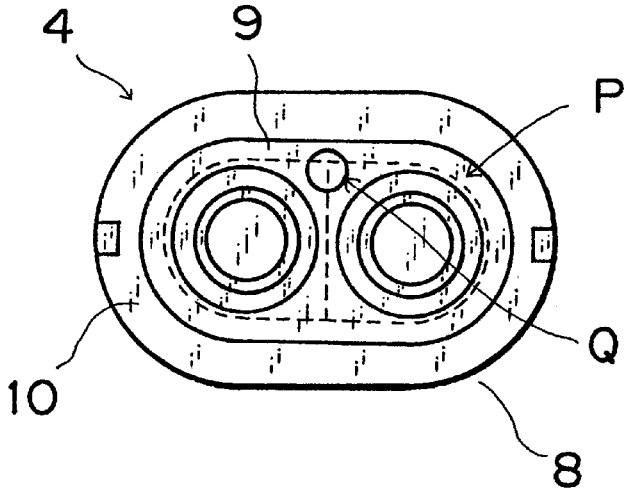
FIG. 18 PRIOR ART
FIG. 18 is a front view of a rear cover illustrating a positional relationship between an injection inlet and an insertion part of the mold shown in FIG. 17.

The mold-release force is very small due to the structure of the mold shown in FIG. 17, causing no possibility of a deformation or damage for the hood 35.

The use of the insertion part 24 makes maintenance of the fixed mold 22' (see FIG. 17) remarkably better and fin formation caused by wear of the mold is surely prevented by replacing the insertion part 24 regularly.

In the following, another preferred embodiment of the rear cover is explained with reference to FIGS. 4 through 7.

Figure 4:
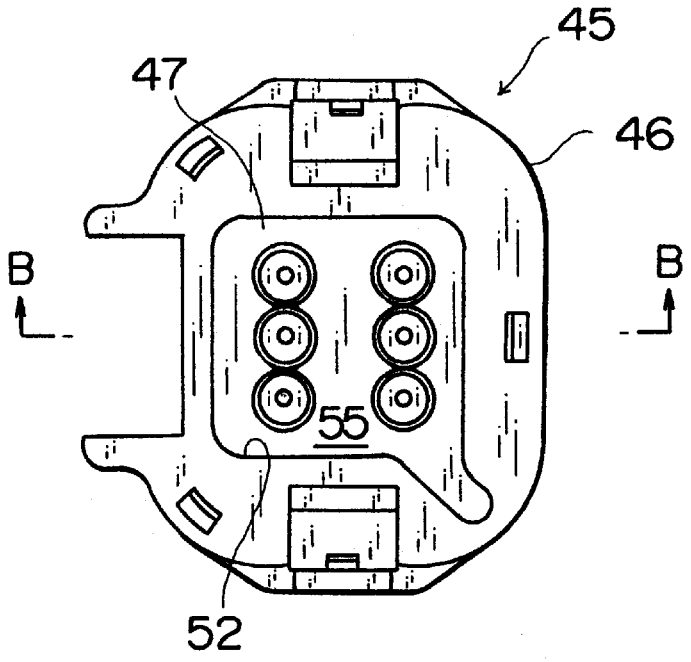
FIG. 4 is a front view of another rear cover according to the present invention.
Figure 5:
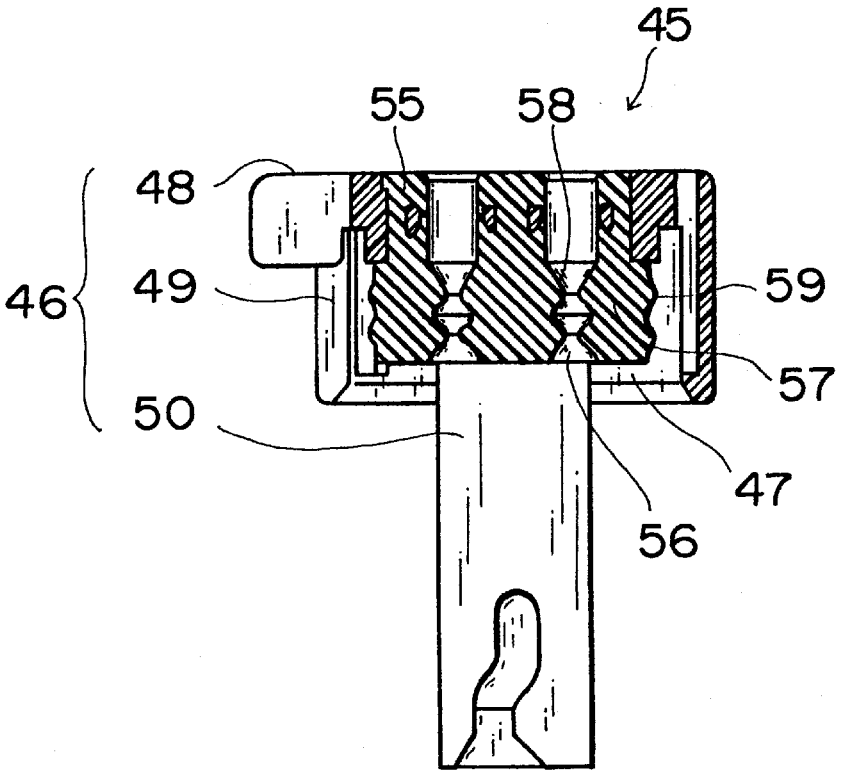
FIG. 5 is a cross-sectional view taken along B—B line in FIG. 4.

In FIGS. 4 and 5, a rear cover 45 includes a rear cover body 46 made of synthetic resin and a resilient seal member 47 made of waterproof rubber (for example, silicone rubber) molded in one piece in the rear cover body 46.

Figure 6:
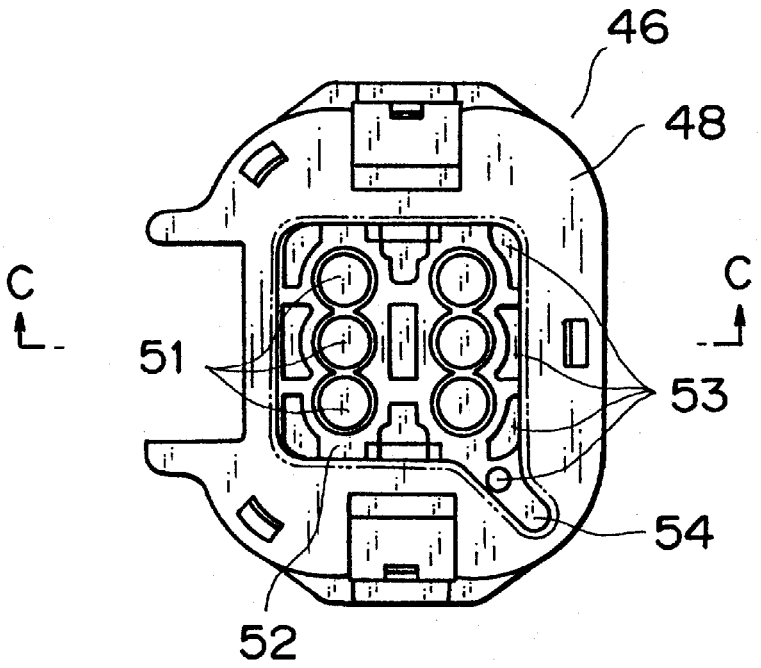
FIG. 6 is a front view of the rear cover body shown in FIG. 4.
Figure 7:
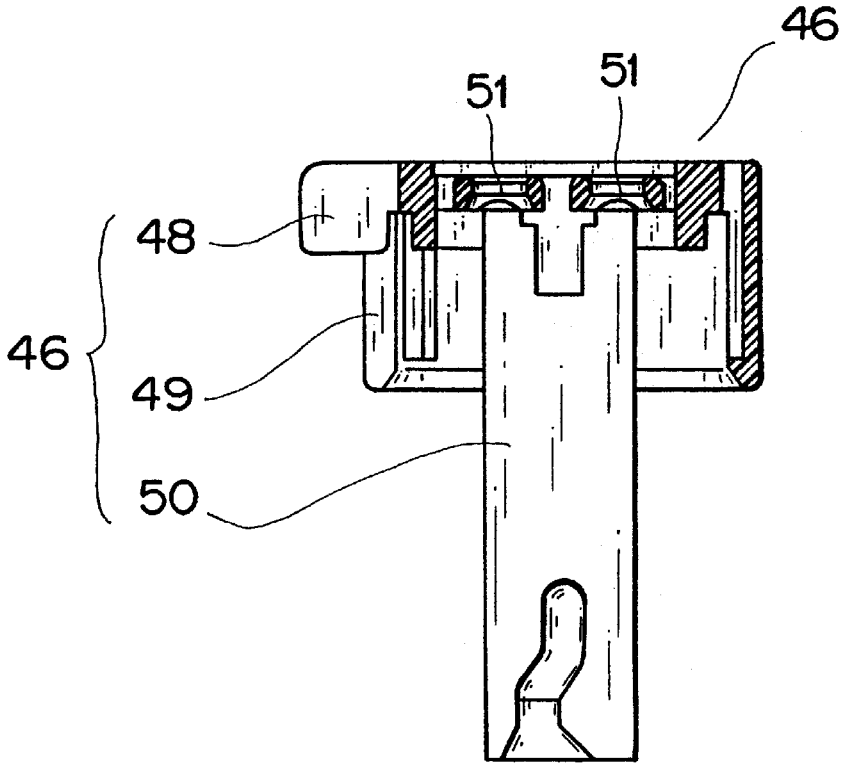
FIG. 7 is a cross-sectional view taken along C—C line in FIG. 6.
Figure 8:
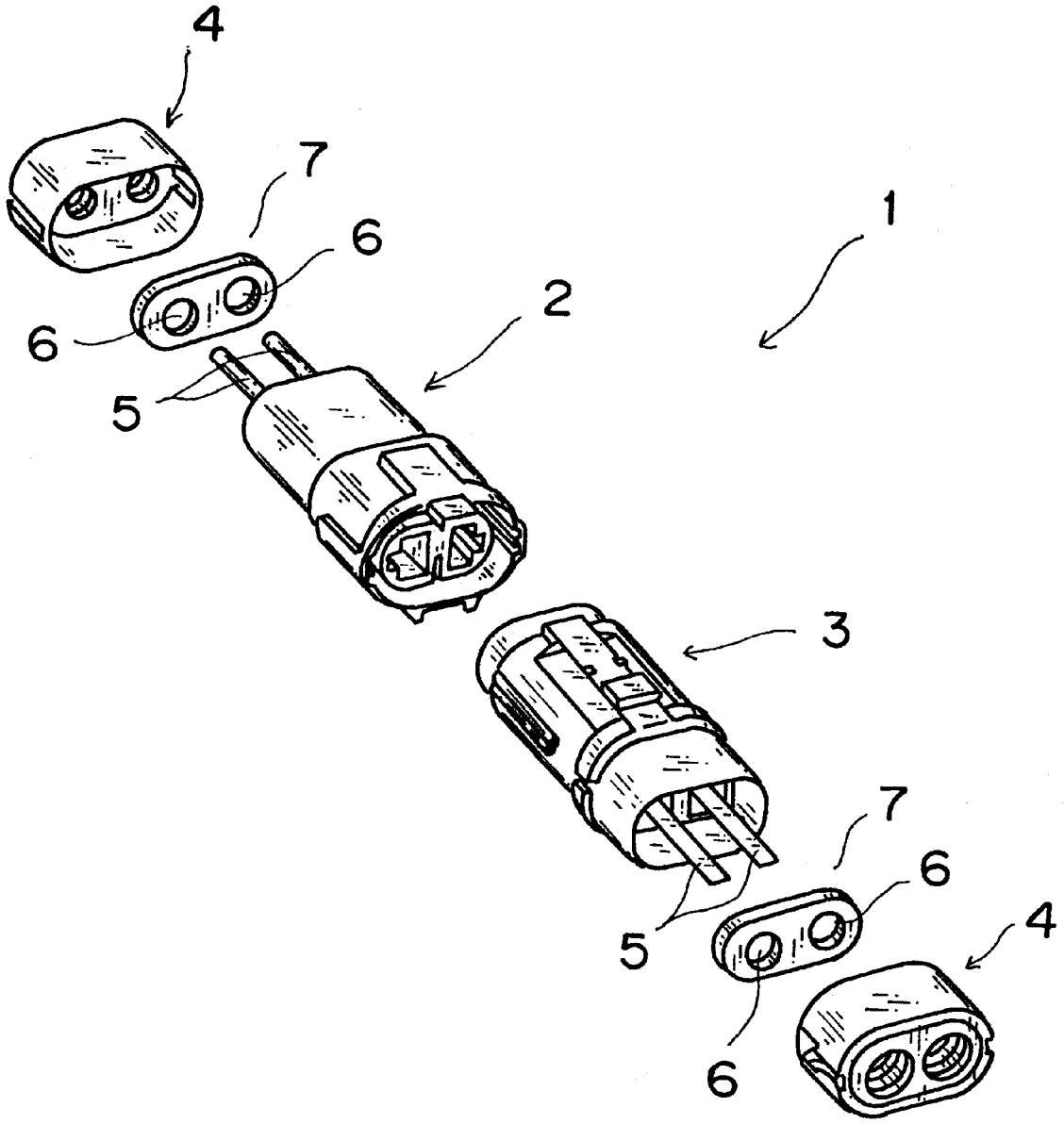
FIG. 8 PRIOR ART
FIG. 8 is an exploded perspective view of a waterproof connector illustrating a conventional rear cover.
Figure 9:
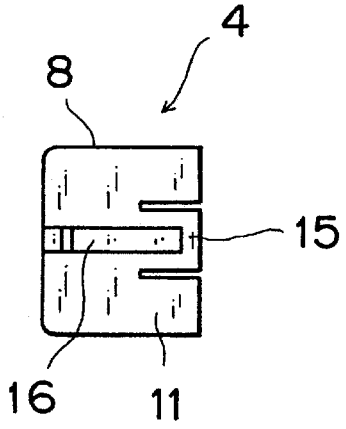
FIG. 9 PRIOR ART
FIG. 9 is a side view of the rear cover shown in FIG. 8.
Figure 10:
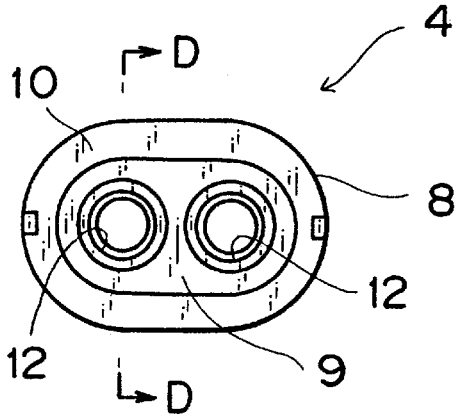
FIG. 10 PRIOR ART
FIG. 10 is a front view of the rear cover shown in FIG. 8.
Figure 11:
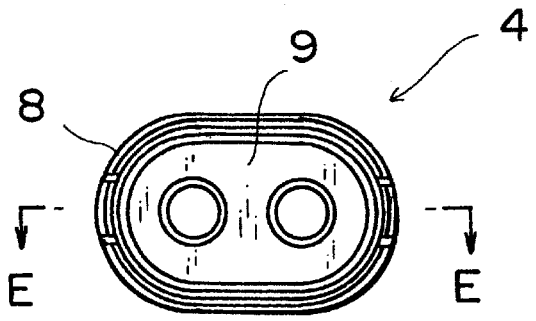
FIG. 11 PRIOR ART
FIG. 11 is a rear elevation of the rear cover shown in FIG. 8.
Figure 12:
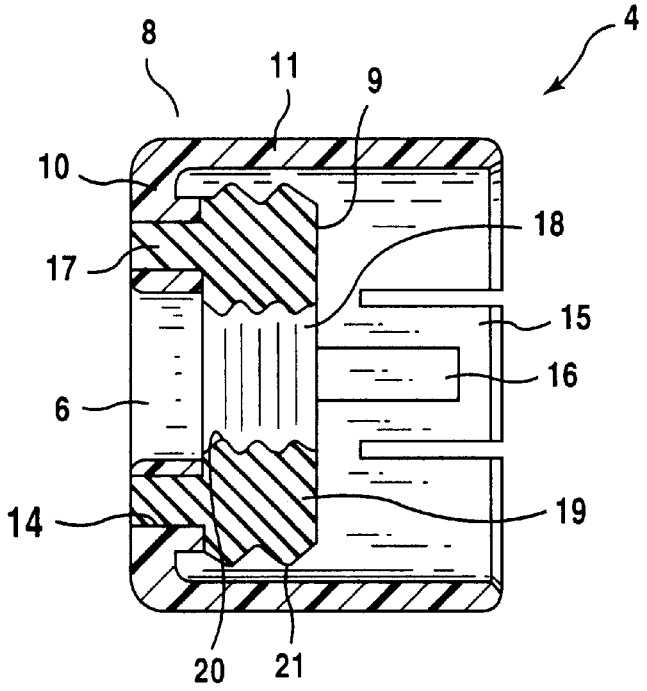
FIG.12 PRIOR ART
FIG. 12 is a cross-sectional view taken along D—D line in FIG. 10.
Figure 13:
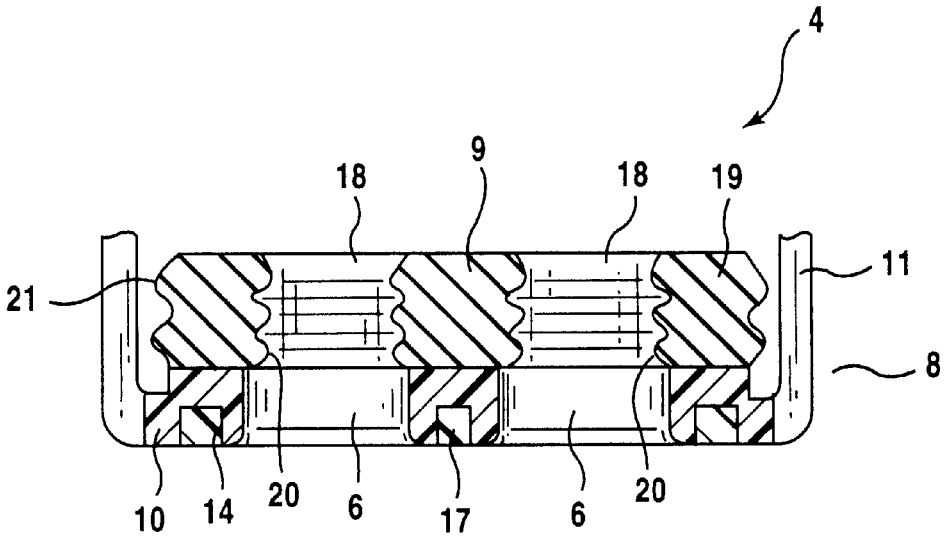
FIG.13 PRIOR ART
FIG. 13 is a cross-sectional view taken along E—E line in FIG. 11.
Figure 14:
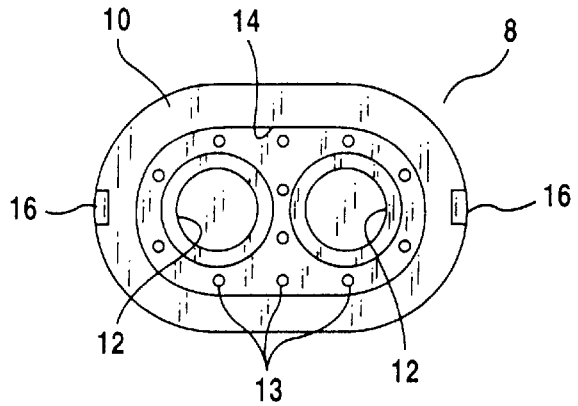
FIG.14 PRIOR ART
FIG. 14 is a front view of the rear cover body shown in FIG. 8.
Figure 15:
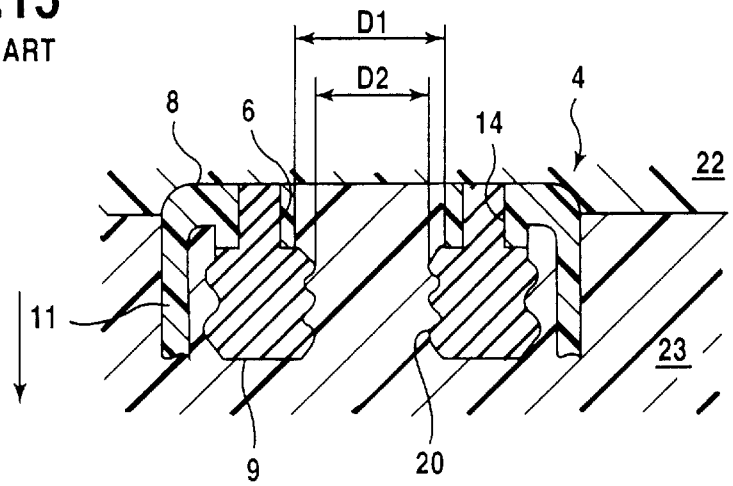
FIG.15 PRIOR ART
FIG. 15 is a cross-sectional view illustrating a process for producing the rear cover shown in FIG. 8.
Figure 16:
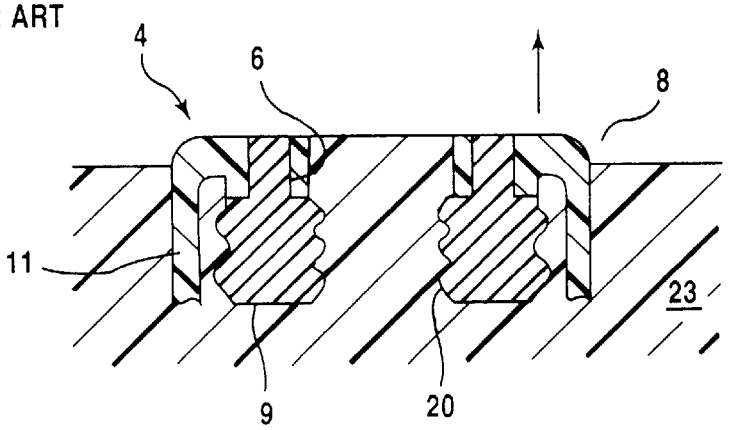
FIG.16 PRIOR ART
FIG. 16 is a cross-sectional view illustrating a release of the rear cover from the movable mold shown in FIG. 15.

As shown in FIGS. 6 and 7, the rear cover body 46 has a base wall 48, a hood 49 formed around the periphery of the base wall 48, and a pair of a rectangular fitting pieces 50 (only one of them shown in FIG. 7) protruding toward an inner face side of the base wall 48, in which six round through-holes 51 (see FIG. 6) for an electric wire (not shown) to pass through between an inner and outer faces of the base wall 48 are formed in two lines, each line including three through-holes.

As shown in FIG. 6, on an outer face of the base wall 48, there are formed a hollow holder pattern 52 fringed in rectanglar shape and a plurality of holes 53 extending to an inner face of the base wall 48.

Further, on an outer face of the base wall 48, a hollow 54 is formed by notching a portion of a fringe of the hollow holder pattern 52, that is, notching a corner (not limited to the corner shown in FIG. 6) in a diagonal direction, in which an injection inlet (not shown) for molding the resilient seal member 47 in one piece can be placed.

As shown in FIG. 5, the resilient sealing member 47 contains: a rectanglar board-shape holder 55 formed by filling the hollow holder pattern 52 with a waterproof rubber; a sealing body 57 extended from the holder 55, which has six (two in FIG. 5) through holes 56 for the electric wire (not shown) to pass therethrough and protrudes toward the inner face side of the base wall 48; and a plurality of sealing lips 58 (two in this embodiment) each formed around the corresponding through hole 56, in which a plurality of sealing lips 59 (two in this embodiment) are also formed around the sealing body 57.

The rear cover 45 thus constructed performs the similar effect to the rear cover 31. Although the rear cover 45 is constructed for use with a multiple-set of terminals, it can be molded using a mold having a structure shown in FIG. 17 without causing any problem.

The aforementioned preferred embodiments are described to aid in the understanding of the present invention, and variations may be made by one skilled in the art without departing from the spirit and scope of the present invention.

What is claimed is:

1. A rear cover, in which an electric wire is inserted through a base wall, said rear cover having a hollow holder pattern disposed on an outer surface of the base wall and a molded-in resilient sealing member, said rear cover comprising:

a holder formed in the holder pattern;

a sealing body extended from the holder, to protrude toward an inner side of the base wall and has a through-hole for the electric wire to pass therethrough; and a plurality of sealing lips formed around the through-hole, wherein a portion of a periphery of the holder pattern is notched to form a hollow defining an injection inlet to introduce resilient sealing material for molding the molded-in sealing resilient member.

2. A process for forming a resilient sealing member in a rear cover comprising the steps of:

providing a rear cover body including a base wall, said rear cover body having a hollow holder pattern and a hollow defining an injection inlet contiguous with said hollow holder pattern by notching a portion of a periphery of the hollow holder pattern on an outer surface of said base wall; mounting the rear cover in a mold; and filling the hollow holder pattern with a resilient seal material through the hollow defining said injection inlet, thereby producing a one piece resilient sealing member molded in said rear cover and including:

a holder formed of resilient seal material and disposed in the holder pattern;

a sealing body extended from the holder, said sealing body protruding toward an inner side of the base wall and having a through-hole for an electric wire to be inserted through the rear cover; and a plurality of sealing lips formed around the through-hole, is molded in one piece in the rear cover.

* * * * *